US006471509B2

(12) United States Patent
Ruiter

(10) Patent No.: US 6,471,509 B2
(45) Date of Patent: Oct. 29, 2002

(54) STRIP GUIDING DEVICE COMPRISING A ROTATABLE CONSTRUCTION FOR CHANGING SUPPORTING ROLLS HAVING COOLING MEANS

(75) Inventor: Leo Antonius Ruiter, Krimpen aan den IJssel (NL)

(73) Assignee: Thermtec B.V., Rotterdam (NL)

( * ) Notice: Subject to any disclaimer, the term of this patent is extended or adjusted under 35 U.S.C. 154(b) by 0 days.

(21) Appl. No.: 09/899,811

(22) Filed: Jul. 6, 2001

(65) Prior Publication Data

US 2002/0022206 A1 Feb. 21, 2002

Related U.S. Application Data

(63) Continuation of application No. PCT/NL99/00822, filed on Dec. 30, 1999.

(30) Foreign Application Priority Data

Jan. 6, 1999 (NL) ..... 1010971

(51) Int. Cl.[7] ..... F26B 13/18
(52) U.S. Cl. ..... 432/59; 432/8
(58) Field of Search ..... 432/8, 59, 64, 432/77

(56) References Cited

U.S. PATENT DOCUMENTS

| | | | | |
|---|---|---|---|---|
| 3,716,221 A | * | 2/1973 | Gorka et al. | 432/59 |
| 3,751,195 A | * | 8/1973 | Snow | 432/8 |
| 4,049,372 A | | 9/1977 | Bloom | |
| 4,069,008 A | | 1/1978 | Bloom | |
| 4,182,611 A | | 1/1980 | Knaak | |
| 4,538,986 A | | 9/1985 | Blomqvist et al. | |

FOREIGN PATENT DOCUMENTS

| | | |
|---|---|---|
| EP | 0 862 033 | 9/1998 |
| FR | 1 370 251 | 12/1964 |
| FR | 2 344 800 | 10/1977 |
| FR | 2 385 061 | 10/1978 |
| FR | 2 540 138 | 8/1984 |
| FR | 2 660 935 | 10/1991 |

* cited by examiner

*Primary Examiner*—Gregory Wilson
(74) *Attorney, Agent, or Firm*—Thomas R. Vigil; Welsh & Katz, Ltd.

(57) ABSTRACT

Strip guiding device for guiding hot metal strip, comprising a frame, a support construction which is accommodated in the frame in such a manner that it can rotate about an axis, drive means for the stepwise rotation of the support construction in the frame, at least two supporting rolls which are rotatably and removably arranged in the support construction, insulating means which are connected to the support construction and are positioned between the supporting rolls, and cooling means for cooling each supporting roll, in which device the cooling means for each supporting roll comprise a cooling body which is connected to the support construction, each cooling body extending in the longitudinal direction of the associated supporting roll, externally delimiting this roll over part of the circumference, and being positioned at a distance from the support roll, each cooling body cooling the associated supporting roll as a result of direct radiation from the said roll.

10 Claims, 2 Drawing Sheets

STRIP GUIDING DEVICE COMPRISING A ROTATABLE CONSTRUCTION FOR CHANGING SUPPORTING ROLLS HAVING COOLING MEANS

CROSS-REFERENCE TO RELATED APPLICATIONS

This is a continuation application of PCT/NL99/00822 filed Dec. 30, 1999.

FIELD OF THE INVENTION

The invention relates to a strip guiding device of the type having a rotatable support construction with supporting rolls.

BACKGROUND OF THE INVENTION

Strip guiding devices of this nature are known, inter alia from DE-C-3401792. This document describes a strip guiding device which is intended to guide hot metal strip over supporting rolls between or inside horizontal furnace chambers of a continuous annealing furnace. In this case, the metal strip hangs freely between two or more strip guiding devices as it moves through the furnace chambers. Continuous annealing furnaces are in widespread use, for example, for the oxidative annealing of stainless strip in a so-called annealing and pickling line. These furnaces operate at high temperatures and high production capacities. The strip guiding device in DE-C-34 01 792 comprises a support construction in roll form which is rotatably accommodated in a frame. Two diametrically opposite, cylindrical cavities are formed in the roll-like support construction, in which cavities two supporting rolls are accommodated in a freely rotatable manner. The roll-like support construction substantially comprises a solid body with cooling lines which extend inside it. The solid body provides insulation against the high temperatures in the furnace chamber for the supporting roll which is not in operation. Maintenance on the supporting roll which is at the top in operation can be carried out by rotating the support construction through 180 °.

A drawback of the known strip guiding device is that the service life of the supporting rolls is limited by the insulating action. The temperature of the supporting roll which is in operation and over which the hot metal strip is guided rises considerably, which has an adverse effect on the service life of the supporting roll. In addition, the high temperature increases so-called "pick-up" phenomena, i.e. the accumulation of small particles on the running surface of the supporting roll, leading to damage to the hot metal strip which is guided over it. In order to reduce the temperature of the supporting roll, it is possible, inter alia, to arrange cooling means inside the supporting rolls. In the case of so-called fiber rolls, i.e. supporting rolls which are coated with fiber discs, however, the cooling action is limited owing to the insulating action of the fiber material. In practice, it has been found that indirect cooling of an operating supporting roll which is accommodated in a rotatable support construction by means of internal cooling lines does not sufficiently reduce the temperature of the running service of this supporting roll. It is also known, in the case of metal supporting rolls with a metal outer casing, to guide cooling water directly along the inside of the outer metal casing. However, this results in very high heat losses from supporting rolls of this nature, and consequently the local cooling, particularly in the case of thin metal strip which is to be annealed, on the outer casing of the supporting roll is so high that it may lead to deformation of the metal strip.

A strip guiding device is also known from U.S. Pat. No. 4,039,372. This patent shows a rotatable support construction for two supporting rolls of a strip guiding device. Between the supporting rolls an isolation shield is provided having a central cooling chamber surrounded by top and bottom layers of insulation material. The shield provides insulation against the high temperatures in the furnace chamber for the supporting roll which is not in operation. Each supporting roll is provided with an internal cooling liquid pipe extending over the entire length of the supporting roll.

A drawback of this known strip guiding device is that the cooling means inside the supporting rolls are not able to provide for a uniform and sufficient cooling of the running surface of the supporting roll in operation. Like the device of DE-C-3401792, the service life of the supporting rolls used with the support construction according to U.S. Pat. No. 4,049,372 is limited, leading to damages to hot metal strip guided over it and limitations in production capacities and furnace temperatures.

SUMMARY OF THE INVENTION

The object of the invention is to overcome the above mentioned drawbacks, and, in particular, to provide a strip guiding device in which supporting rolls can be changed quickly, while at the same time a maximum possible service life of the supporting rolls at high furnace temperatures and high production capacities is also achieved. In particular, the object of the invention is to provide a strip guiding device in which good service lives can be achieved even for supporting rolls which are covered with fiber discs. Supporting rolls of this nature are preferably used for guiding this, cold-rolled metal strip, which is highly susceptible to damage.

According to the invention, these objects are achieved by means of a strip guiding device for guiding hot metal strip, comprising a frame, a support construction which is accommodated in said frame rotatable about an axis, drive means for stepwise rotation of said support construction in said frame, at least two supporting rolls which are rotatably and removably arranged in said support construction, insulating means which are connected to said support construction and are positioned between said supporting rolls, and cooling means for cooling each supporting roll. The cooling means for each supporting roll comprise a cooling body which is connected to said support construction and extends in a longitudinal direction of the associated supporting roll, wherein each cooling body externally delimits said associated supporting roll over more than 90° of its circumference, and is positioned at a distance from said support roll for cooling said associated supporting roll as a result of direct radiation. The strip guiding device comprises a support construction which is mounted in a frame and can be rotated in steps by means of drive means. At least two rotatable and exchangeable supporting rolls are arranged in the rotatable support construction. The supporting rolls are thermally insulated from one another by means of insulating means which are connected to the support construction. An external cooling body is provided for each supporting roll. The cooling bodies are connected to the support construction, each cooling body externally surrounding the associated supporting roll over at least a quarter of its circumference. There is a small space between the cooling bodies and the supporting rolls. In operation, the top supporting roll, over which hot metal strip is guided, is cooled as a result of direct radiation to the cooling body. This allows the running surface of the supporting roll to be cooled in a very uniform but not excessively intensive manner. The resultant uniform, limited reduction in the temperature of the running surface significantly improves the service life of the supporting roll and considerably reduces pick-up, or even eliminates this phenomenon altogether. It has been found that with the strip guiding device according to the invention, fiber rolls can be used up to a few weeks even at very high temperatures, whereas in the devices used hitherto the supporting rolls often had to be replaced after only a few days. A further advantage is that a supporting roll which has been rotated out of its operating position can be cooled rapidly and uniformly, with the result that maintenance or replacement of the supporting roll can be carried out quickly. The efficient cooling of the running surface by means of direct radiation of heat from the roll advantageously allows a higher operating temperature of a furnace to be established without this leading to adverse "pick-up" phenomena or defects on the material of the supporting rolls. Furnace temperatures of up to approx. 1250° C. are advantageously quite possible. In practice, it has been found that the temperature of the running surface of the operating supporting roll, via the cooling body which delimits more than 90° of the circumference of the supporting roll, is cooled sufficiently to allow the supporting roll to rotate at high speeds, thus allowing high production capacities.

It should be noted that FR-A-1,370,251 has disclosed a strip guiding device with bearing rolls which are accommodated in cavities in a solid thermally insulating body. Beneath each cavity, there is a cooling-liquid pipe for cooling the bearing roll via direct radiation of heat. However, this construction as such is relatively unsuitable for use in a strip guiding device comprising a rotatable construction for changing supporting rolls. The removal of heat to the single, narrow cooling-liquid pipe in the bottom of the cavity is extremely limited, and consequently the circumferential speed of the supporting rolls has to be adapted in order to achieve a desired mean temperature for the supporting rolls. At furnace temperatures of over 1000° C., this mean supporting-roll temperature can only be sufficiently low to prevent sagging of the supporting rolls. The "pick-up" phenomenon and other damage to the surface structure of the supporting rolls will still be present. In particular, fiber rolls cannot be used in the construction described in FR-A-1,370,251, since even a temporary standstill of the supporting rolls would within a very short time damage these rolls to such an extent that they would have to be replaced.

The advantage of the construction according to the invention is that it can be used for all types of supporting rolls. For example, it can be used to guide hot-rolled metal strip with an oxide skin over metal supporting rolls provided with a bronze coating. In particular, so-called fiber rolls, in which, for example, metal supporting rolls are covered with fiber discs, can be successfully cooled on their running surface by means of the cooling construction according to the invention. In this way, it is possible for even thin, cold-rolled metal strip, which is highly susceptible to damage, to be guided successfully. It is noted that effective cooling of the running surface of fiber rolls with the heat being dissipated to a cooling body located inside the fiber roll is impossible, or only possible with great difficulty, owing to the very low coefficient of thermal conductivity of the fiber discs.

In particular, the cooling body delimits more than 140° of the circumference of the associated supporting roll. The extensive surrounding delimitation of the supporting roll by the cooling body ensures that there is sufficient cooling of the supporting roll even if the metal strip, and consequently the supporting roll, are temporarily at a standstill. This is advantageous since, in the known strip guiding devices, if the hot metal strip is at a standstill the support construction has to be rotated through an angle of 90°, in order to prevent damage to the supporting roll as a result of overheating. In the case of the strip guiding device according to the invention, rotation of this nature is only necessary in the event of a defect to the cooling body or the cooling system.

BRIEF DESCRIPTION OF THE DRAWINGS

The invention will be explained in more detail with reference to the appended drawing, in which.

DESCRIPTION OF THE PREFERRED EMBODIMENT

Figure 1:
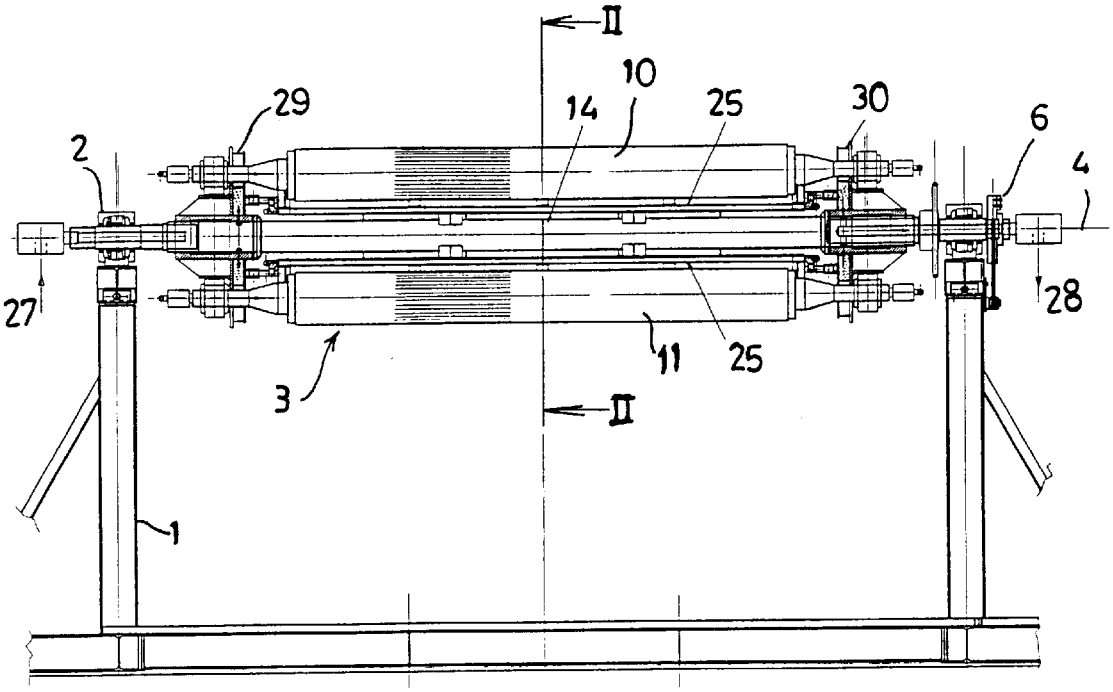
FIG. 1 shows a view in longitudinal section of a strip guiding device according to the invention.

The strip guiding device shown in FIG. 1 comprises a frame 1 with two upright legs. Each leg is provided with bearing means 2 in which a support construction 3 is accommodated in such a manner that it can rotate about an axis 4. The vertical leg of the frame 1 which is located on the right-hand side comprises drive means 6 for the stepwise rotation of the support construction 3 in the frame 1. The support construction 3 has a top supporting roll 10 and a bottom supporting roll 11. The supporting rolls 10, 11 are usually mounted in a freely rotatable manner in the support construction 3; however, they may also be driven.

Figure 2:
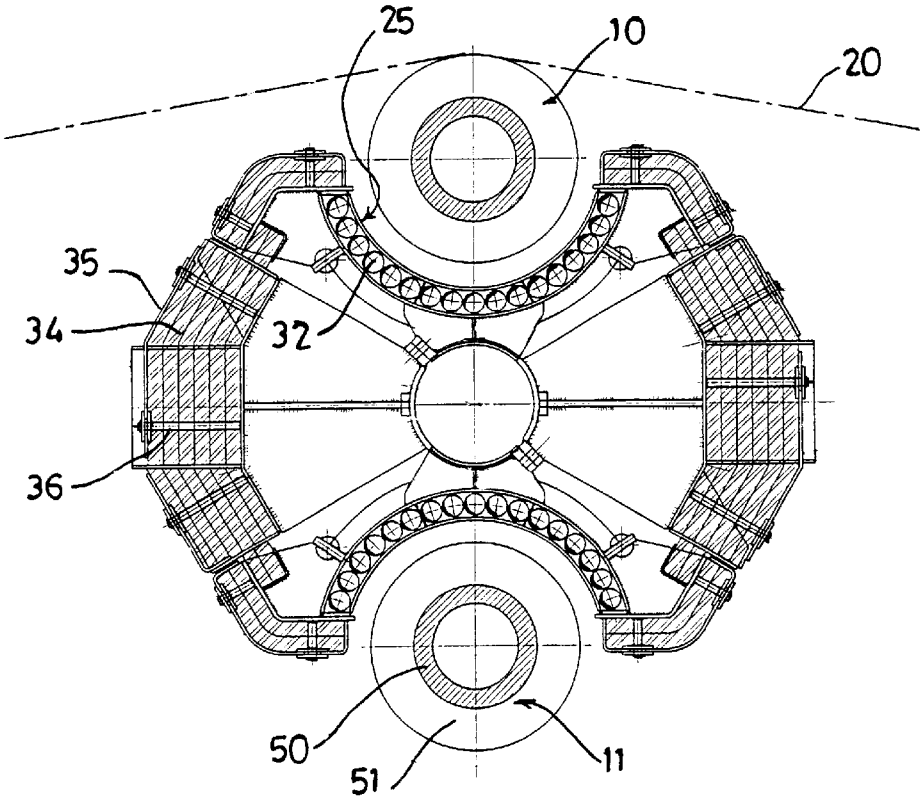
FIG. 2 shows a view on an enlarged scale on line II—II in FIG. 1.

The strip guiding device is intended to guide hot metal strip between or inside furnace chambers of a horizontal annealing furnace. In FIG. 2, the metal strip is diagrammatically illustrated and is denoted by the reference numeral 20. In operation, the metal strip 20 is guided over the supporting roll 10. If necessary, maintenance can be carried out on the supporting roll 10 in a simple manner, by rotating the support construction 3 through an angle of 180°. In this way, the supporting roll 10 moves to the bottom. While maintenance is being carried out on the supporting roll 10, the metal strip 20 is guided over the supporting roll 11.

The support construction 3 comprises a central pipe 14 on which cooling and insulating means are mounted. The cooling and insulating means are arranged between the supporting rolls 10 and 11 and extend over the entire length of the supporting rolls 10, 11.

The cooling means comprise an external cooling body 25 for each supporting roll 10, 11 respectively (cf. FIG. 2). Each cooling body 25 is located to the side of the associated supporting roll 10, 11, with a small gap left between the supporting roll 10, 11 and the cooling body 25. The cooling body 25 delimits a large part of the outer circumference of the supporting roll 10, 11, in particular almost half its external circumference. The cooling body 25 is permanently cooled, so that some of the heat from the supporting roll 10 which is in operation, which heat emanates from the hot metal strip and the furnace, can be dissipated to the cooling body 25 as a result of direct radiation of heat. The cooling body 25 is also permanently cooled. If the supporting roll 11 has just been rotated out of its operating position, its heat can be dissipated to the cooling body 25 as a result of direct radiation of heat. This allows maintenance work on the supporting roll 11 to be carried out rapidly.

Advantageously, the cooling body 25 comprises a liquid-cooled body which is connected to a cooling-medium inlet 27 and a cooling-medium outlet 28 (cf. FIG. 1). The cooling medium, for example water or oil, enters one end of the pipe 14 via the cooling-medium inlet 27 and, from there, moves into the top and bottom cooling bodies 25 via a manifold 29. After the cooling medium has flowed through the cooling bodies 25, it is discharged via a manifold 30, an end of the pipe 14 and, from there, to the cooling-medium outlet 28. The central supply and discharge of cooling medium along the axis 4 is advantageous in particular during rotation of the support construction 3.

The cooling body 25 may be designed in various ways, for example in the form of a plurality of pipes 32 which are positioned next to one another and are each connected to the cooling-medium inlet 27 and cooling-medium outlet 28. It is also possible to use one or more pipes which extend in meandering form through the cooling body 25. The advantage of this option is that just one connection to the cooling-medium inlet and outlet will be sufficient.

To insulate and protect the support construction 3, there are insulating shells 34 between the cooling bodies 25. Stacked sets of insulating shells 34 are covered by heat-resistant plates 35. The sets of insulating shells 34 and heat-resistant plates 35 are held together with the aid of securing pins 36.

Figure 3:
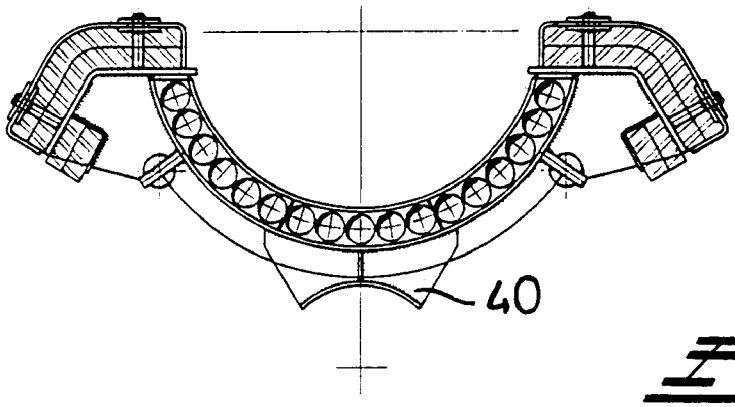
FIG. 3 shows a view of part of a cooling body from FIG. 2.
Figure 4:
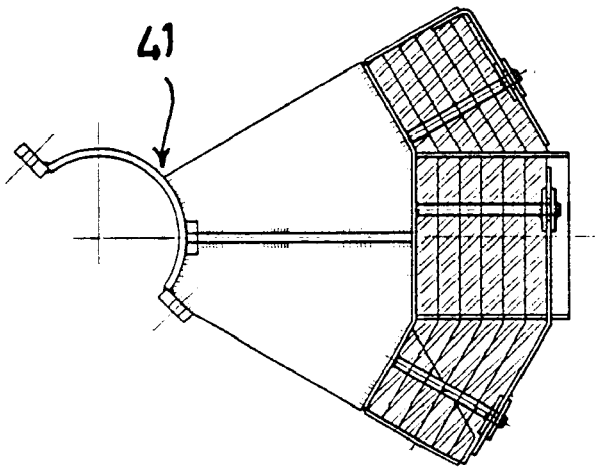
FIG. 4 shows a view of part of an insulating means segment from FIG. 2.

The cooling and insulating means between the supporting rolls 10, 11 are preferably of segmented structure and are separately attached to the pipe 14 of the support construction 3. This makes it possible to remove the separate segments without the entire support construction 3 having to be dismantled. The segmented structure can be clearly seen from FIGS. 3 and 4. Both the cooling-means segment from FIG. 3 and the insulating-means segment from FIG. 4 are provided with a supporting rib 40 and 41, respectively, by means of which the segments can be fitted to one another and to the pipe 14. The insulating means are advantageously designed in such a manner that those edges of the cooling means which are located furthest outwards are protected from heat being radiated in directly from the furnace. This prevents excessive heat absorption.

The heat-resistant plates 35 substantially lie at a lesser radius from the center axis 4 of the support construction 3 than the outermost parts of the supporting rolls 10, 11. During rotation of the support construction 3, the metal strip 20 can be supported on the heat-resistant plates 35 without damaging the insulation. In operation, part of the strip guiding device projects inwards through an opening in a bottom wall of a horizontal annealing furnace and/or adjoins a strip-feed or strip-removal opening in a side wall of the furnace. In order to allow rotation of the support construction, a gap is left clear between the edges of the opening in the furnace wall and the strip guiding device. In this case, it is advantageous for the heat-resistant plates 35 to be at a shorter radius from the centre axis 4 than the outermost parts of the supporting rolls 10, 11. Any contamination, for example burnt-on metal residues, which builds up at the location of the edges of the opening is consequently free to fall downwards without becoming jammed between the plates 35 and the edges of the opening. During rotation of the support construction 3, the strip which is to be guided is lowered a few centimeters until it is supported on the plates 35. To prevent the loss of flue gases from the furnace, partly as a result of the plates 35 being positioned at a shorter radius, air curtains are positioned along the entire length and at the ends of the support construction 3, which curtains seal the furnace housing at the location of the gaps which have been left clear between the edges of the opening and the strip guiding device.

To prevent steam from flue gases in the annealing furnace condensing on surfaces of the cooling body 25 and other water-cooled parts, the cooling medium is supplied at a specific initial temperature. This initial temperature is such that a temperature below the dewpoint on the surface of the cooling body 25 and other water-cooled parts is prevented. The initial temperature of the cooling medium is in particular in the vicinity of 40–45° C.

In the case of thin strip, the supporting rolls 10, 11 are advantageously formed by so-called fiber rolls. In this case, each supporting roll substantially comprises a metal inner pipe 50 (cf. FIG. 2) over which a plurality of discs 51 have been pushed, their outer edges together forming a running surface of the supporting roll. Each disc 51 is in this case made from fibrous material. The design of the strip guiding device according to the invention makes it possible to use fiber rolls of this nature, since the temperature of the running surface of the fiber rolls can be kept within permissible limits as a result of the direct radiation of heat to the cooling body located beneath it.

Thus, the invention provides a strip guiding device with a rotatable support construction having two supporting rolls, in which the service life of the supporting rolls is very long and a high operating temperature of an annealing furnace can be used without this leading to an excessive temperature of the supporting roll which is in operation.

What is claimed is:

1. Strip guiding device for guiding hot metal strip, comprising:

a frame;

a support construction which is accommodated in said frame rotatable about an axis;

drive means for stepwise rotation of said support construction in said frame;

at least two supporting rolls which are rotatably and removably arranged in said support construction;

insulating means which are connected to said support construction and are positioned between said supporting rolls; and cooling means for cooling each supporting roll; in which said cooling means for each supporting roll comprise a cooling body which is connected to said support construction and extends in a longitudinal direction of the associated supporting roll, wherein each cooling body externally delimits said associated supporting roll over more than 90° of its circumference, and is positioned at a distance from said support roll for cooling said associated supporting roll as a result of direct radiation.

2. Strip guiding device according to claim 1, in which said cooling body delimits more than 140° of the circumference of said associated supporting roll.

3. Strip guiding device according to claim 1, in which said cooling body comprises a liquid-cooled body with a cooling-medium inlet and a cooling-medium outlet.

4. Strip guiding device according to claim 3, in which said cooling body comprises at least one meandering pipe.

5. Strip guiding device according to claim 1, in which said insulating means comprises insulating shells which extend between said cooling bodies of said supporting rolls.

6. Strip guiding device according to claim 5, in which said insulating shells are covered by a heat-resistant plating.

7. Strip guiding device according to claim 6, in which said heat-resistant plating is located substantially at a shorter radius from said axis of said support construction than those parts of said supporting rolls which lie furthest outwards.

8. Strip guiding device according to claim 1, in which said insulating means are of segmented design and are separately removably attached to said support construction.

9. Strip guiding device according to claim 1, in which said cooling bodies are separately removably attached to said support construction (3).

10. Strip guiding device according to claim 1, in which said supporting roll comprises a core which is covered with fiber discs.

* * * * *